US005353000A

United States Patent [19]

Morris et al.

[11] Patent Number: 5,353,000

[45] Date of Patent: Oct. 4, 1994

[54] SHUNTABLE LOW LOSS VARIABLE CURRENT VAPOR COOLED LEADS FOR SUPERCONDUCTIVE LOADS

[75] Inventors: Dean G. Morris, San Diego; Michael Heiberger, Cardiff; Edward E. Bowles, San Diego, all of Calif.

[73] Assignee: General Atomics, San Diego, Calif.

[21] Appl. No.: 69,763

[22] Filed: Jun. 1, 1993

[51] Int. Cl.[5] ..... H01F 7/22

[52] U.S. Cl. ..... 335/216; 174/15.4; 61/51.1

[58] Field of Search ..... 62/51.1, 51.3; 361/19, 361/141; 335/216; 174/15.4, 15.5; 505/892, 893, 898

[56] References Cited

U.S. PATENT DOCUMENTS 3,695,057 12/1972 Moisson-Franckhouser ..... 174/15.5
4,369,636 1/1983 Purcell et al. ..... 62/514

*Primary Examiner*—Leo P. Picard
*Assistant Examiner*—Raymond Barrera
*Attorney, Agent, or Firm*—Fitch, Even, Tabin & Flannery

[57] ABSTRACT

A shuntable low loss variable current vapor cooled lead (VCVCL) configuration delivers current to and from a superconductive load, such as a superconductive magnet, immersed in a cryogenic liquid in a way that minimizes the boil-off rate of the cryogenic liquid. The VCVCL configuration includes superconductive lead assemblies containing superconductive segments. The assemblies are connected in parallel between the superconductive load and an output current source or sink. Each assembly is controlled so that its superconducting segment is either superconducting or non-superconducting. By selectively controlling whether each lead assembly is superconducting or non-superconducting, by varying the cryogenic liquid level, the current flow to or from the superconducting load through the lead assemblies is shunted from those lead assemblies exhibiting a relatively high resistance to those having a relatively low resistance, and the current is selectively distributed between superconducting lead assemblies so that each lead assembly either carries near zero current or an optimum current. At near zero current, the lead assembly contributes very little to the helium boil-off rate because of negligible Joule heating, and because the path of thermal conduction to the liquid helium is significantly more resistive. At or near the optimum current, the helium boil-off rate approaches a theoretical minimum. By keeping the current in each lead assembly at near zero or near the optimum design current, the helium boil-off rate of the VCVCL configuration is minimized and is significantly less than that of conventionally designed lead arrays.

19 Claims, 6 Drawing Sheets

SHUNTABLE LOW LOSS VARIABLE CURRENT VAPOR COOLED LEADS FOR SUPERCONDUCTIVE LOADS

BACKGROUND OF THE INVENTION

The present invention relates to cooling systems for superconducting magnets or other superconductive loads, and more particularly to methods and apparatus for reducing the heat transferred into a containment vessel through current leads that connect with a superconducting magnet (or other superconducting load) placed within the containment vessel.

An important application of the principle of superconductivity is the creation by superconductive magnets of dissipation-free magnetic fields of high intensity that are unapproachable by ordinary magnetic means. Superconducting magnets are comprised of windings of superconductive material, i.e., material which exhibits zero electrical resistance below a critical temperature. Because there is no resistive loss in the windings of a superconductive magnet, very high currents may be maintained in the windings, producing the high magnetic fields.

Superconductive windings are most commonly formed of NbTi or $Nb_3Sn$, although other superconductive materials may be used. $Nb_3Sn$ is extremely brittle, and it is normally produced in the form of a very thin layer on ribbons of normal metal, such as niobium or stainless steel, and in this form may be wound into coils. Because superconductive windings are subject to flux jumps which may tend to heat up portions of the windings, superconductive windings are normally pressed into close contact with a low resistance metal substrate, such as copper, which shunts portions of the windings. Of course, when the superconductive windings are superconducting (i.e., when they exhibit zero electrical resistance), all of the current flows through the zero-resistance superconductive portion, and none flows through the low-resistance metal substrate portion.

Superconductivity requires extremely low temperatures which are attained through the employment of a cryogenic liquid, most commonly liquid helium with a boiling point of $4.2^{o}$ K. The refrigeration apparatus required to liquefy helium consumes large amounts of energy, and great care must thus be taken to minimize heat transfer to the liquid helium.

A superconductive magnet, or other superconductive load, is immersed within an insulated container or dewar. It is, of course, necessary that the dewar be communicated to the exterior by electrical leads, lines for introducing additional cryogenic liquid, lines for venting vaporized gas and, perhaps, other exterior connections. Disadvantageously, such exterior connections are weak points in the thermal barrier provided by the dewar. The electrical leads are particularly at fault in introducing heat into the dewar as they not only conduct exterior heat (as a thermal conductor), but they also introduce heat as a result of electrical conductance (Joule heating). Thus, there is a need to reduce heat introduction by electrical leads into cryogenic liquid containment vessels wherein superconductive loads, such as superconductive magnets, are housed.

It is known in the art to optimize the design of current-carrying copper leads that connect with a superconductive load immersed in a cryogenic liquid so as to minimize the boil-off rate of the cryogenic liquid. Such optimally designed leads minimize both the heat input to the cryogenic liquid caused by thermal conduction through the lead and Joule heating in the lead resulting from current flow. Such lead design utilizes a lead geometry that is optimized at a maximum design current. At the particular maximum design current, the lead geometry is such that combined heat inputs due to thermal conduction and Joule heating are minimized, and the resulting cryogenic liquid boil-off rate reaches a theoretical minimum. Where the cryogenic liquid is helium, this theoretical minimum at maximum design current is between 1.5 and 1.9 liters/kA-hr, depending on the material properties of the copper. (Note, for purposes of the present application, the cryogenic liquid used in a dewar or similar containment vessel will frequently be referred to hereafter as liquid helium.)

Because the contributions to helium boil-off are due both to (1) thermal conduction and (2) Joule heating from current flow, it is noted that even an optimally designed current lead still exhibits a significant helium boil-off rate when no current is flowing through it. Such condition is very undesirable for superconducting magnets that operate in cold-standby much of the time when no current is flowing, or under conditions when only part of the maximum design current is flowing. The penalty of consuming helium under these conditions may be very significant in terms of electric power that supplies the helium refrigeration plant, particularly where the superconducting magnet is used for SMES (superconducting magnetic energy storage) applications. There is thus a need in the art for a lead design that significantly reduces the helium boil-off rate of superconducting magnet current leads when low current or no current operational modes are used.

One technique known in the art for minimizing the helium boil-off rate when no current is flowing through the superconducting magnet lead is to simply detach the lead. Detaching the lead thus physically removes the thermal conduction path into the liquid helium, and the boil-off rate caused by the lead is thus reduced to zero. Disadvantageously, however, making detachable leads is not an easy task, particularly when the lead must be large enough to carry large currents, e.g., hundreds of killoamperes (kA), as is common in SMES applications. Further, a large lead capable of handling hundreds of kA is also very heavy, and difficult (and expensive, in terms of energy expended) to physically detach or attach in a short time, as is required in SMES applications. Thus, what is needed is a lead design capable of handling large currents, that does not need to be physically detached from a superconducting magnet load, and that significantly reduces the helium boil-off rate when low current or no current operation modes are used.

Another technique known in the art for minimizing the helium boil-off rate is described in U.S. Pat. No. 4,369,636. Such technique reduces the helium boil-off rate by incrementally varying how much of a current lead, serving as the conductor to the superconductive magnet load, is immersed in liquid helium as a function of the current flow through the lead. Thus, as the current flow to the superconductive magnet is reduced, the liquid helium level in which the lead is immersed is incrementally lowered, exposing lower sections of the lead having a smaller cross-sectional area. This raises the length-to-area (L/A) ratio, which re-optimizes the current lead for the lower currents. The lowest zone of the lead can be laced with a superconductor, in order to support full current. The helium boil-off caused by thermal conduction is reduced as the current and liquid helium level is lowered because the lead operates closer to its design optimization value. Disadvantageously, however, control schemes are needed to incrementally control the liquid helium at several levels, which adds to the complexity of the system and tends to reduce reliability. Furthermore, the current lead tends to be physically very long, limiting its practical application.

SUMMARY OF THE INVENTION

The present invention addresses the above and other needs by providing a shuntable low loss variable current vapor cooled lead (VCVCL) configuration that delivers current to and from a superconductive load, such as a superconducting magnet, immersed in liquid helium (or other suitable cryogenic liquid). The VCVCL configuration includes a plurality of current lead arrays (or assemblies) connected in parallel between the superconductive load and the current source and return bus. Each array is controlled so that a portion of it is either superconducting or non-superconducting. When superconducting, a portion of the lead array exhibits superconducting properties (zero resistance), resulting in a total resistance which is relatively low compared to when it is non-superconducting. When non-superconducting, the entire lead in the array exhibits a finite (non-zero) resistance which is higher than the resistance exhibited when a portion of the lead is superconducting. By selectively controlling whether the portion of each lead array is superconducting or non-superconducting, the current flow to or from the superconducting load through the plurality of lead arrays is shunted from those lead arrays exhibiting a higher resistance to those having a lower resistance. Hence, as the current demands of the superconducting load change, the current is selectively distributed between the plurality of superconducting lead arrays by controlling the superconducting properties of each array so that each lead array carries either near-zero current or an optimum current. At near-zero current, the lead array advantageously exhibits a much higher thermal resistance, and thus contributes very little to the helium boil-off rate. At or near the optimum current, the helium boil-off rate approaches a theoretical minimum. Hence, by keeping the current in each lead array at near zero or near the optimum design current, the helium boil-off rate of total lead array is minimized.

In accordance with one aspect of the invention, each lead is made up of an upper and lower segment, with the lower segment being a superconductive segment when covered with liquid helium. Further, each lead array or assembly is housed within a respective containment vessel with its own independent liquid helium level control. When the liquid helium covers the superconductive lower lead segment, it exhibits zero resistance. When the liquid helium level is lowered to the bottom of the containment vessel, the superconductive lower lead segment is not immersed in liquid helium (i.e., is exposed out of the liquid helium) and the lead thus exhibits a finite resistance. Some liquid helium still remains at the bottom of the lower segment since some residual current still flows through the lead, and the lead must still be vapor cooled by liquid helium boil-off gas, albeit at a much reduced boil-off rate. Advantageously, unlike the prior art '636 patent, only two levels of liquid helium are required for control purposes: high or low. Such two-level control can be achieved using a relatively simple control system.

It is thus a feature of the present invention to provide an efficient variable current interface with a superconductive load, such as a superconductive magnet, immersed in a cryogenic liquid. That is, it is a feature of the invention to provide a shuntable low loss variable current vapor cooled lead (VCVCL) configuration that minimizes the helium boil-off rate of the helium with which such VCVCL configuration interfaces.

It is an additional feature of the invention, in accordance with one embodiment, to provide such a VCVCL configuration (i.e., one that minimizes the helium boil-off rate) that operates efficiently over a wide range of current flow.

It is a further feature of the invention to provide a shuntable low loss VCVCL configuration that includes a plurality of current-carrying branches connected in parallel, each of which operates at or near an optimum (maximum) current level, or at a near-zero current level, with each current-carrying branch being designed so that the helium boil-off rate resulting from such branch approaches a theoretical minimum value at the optimum current level, and a low value at the near-zero current level.

It is yet another feature of the invention to provide a shuntable low loss VCVCL configuration that includes a plurality of current-carrying branches connected in parallel that provides a reliable fault-tolerant current lead array by virtue of the fact that if one lead fails to carry current (e.g., burns out) or overheats, current will automatically be shunted to the parallel branches.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
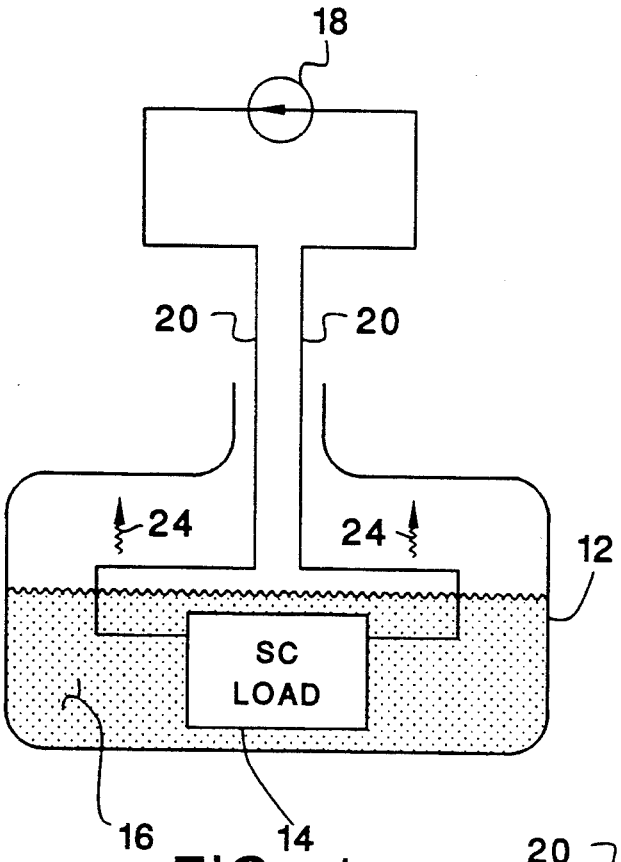
FIG. 1 (PRIOR ART)
FIG. 1 schematically depicts the prior art use of a dewar to immerse a superconductive load, such as a superconductive magnet, in a cryogenic liquid, such as liquid helium.

In order to better understand the problem addressed by the present invention, reference is first made to FIG. 1, where there is shown a simplified schematic representation of the use of a dewar 12 to immerse a superconductive load 14, such as a superconductive magnet, in a cryogenic liquid 16. The load 14 is connected to a power source 18 that is external to the dewar 12. Typically, where the load 14 is a superconductive magnet, the power source 18 is a current source that supplies current to, and receives current from, the superconductive magnet by way of current buses 20 and 22.

The cryogenic liquid 16 may be any suitable liquid that maintains the superconductive load 14 at a sufficiently low temperature to allow the load 14 to exhibit superconductive properties (i.e., zero resistance). Typically, the cryogenic liquid 16 is liquid helium (He), which boils at a temperature of 4.2° K. Hence, for purposes of the present application, the cryogenic liquid will hereafter be referred to as liquid helium (L He).

The dewar 12 is simply a highly thermally insulated container that holds the liquid helium 16. Despite the best thermal design for the dewar, heat transfer into the dewar occurs, causing the liquid helium 16 to boil. The boiling of the liquid helium 16 is represented in FIG. 1 by the wavy arrows 24, symbolically depicting the change in the helium from a liquid state to a gas state. Recycling means are used (not shown in FIG. 1) to capture the escaping helium gas and condense it back into a liquid.

Disadvantageously, the current buses 20 and 22 (which are made from a suitable conductive metal) comprise one of the main sources of heat that causes the liquid helium 16 to boil. Such buses or leads provide both: (1) a thermal path for heat to transfer into the liquid helium from the ambient conditions external to the dewar, and (2) Joule heating resulting from the current flow in the buses (which buses exhibit a finite resistance and therefore dissipate heat in the amount of $I^2R$, where I is the current and R is the resistance of the bus).

As described above, it is known in the art to optimize the design of the current-carrying buses or leads so as to minimize the boil-off rate of the liquid helium. See, e.g., Wilson, Martin, *Superconduction Magnets* (Clarendon Press, Oxford, 1983). Such optimally designed buses or leads minimize both the heat input to the liquid helium caused by thermal conduction through the bus and joule heating in the bus resulting from current flow. An optimally designed bus utilizes a particular geometry that is designed for a maximum design current, $I_{MAX}$.

Figure 2:
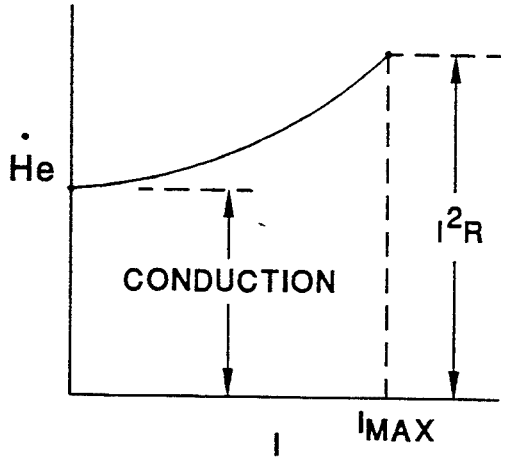
FIG. 2 is a graph that qualitatively depicts the loss of liquid helium to boiling as a function of the electrical current flowing through a conductor that is inserted into the liquid helium.

The boil-off rate as a function of the current flowing through the bus, for currents flowing in an optimally designed bus, is qualitatively illustrated in the graph of FIG. 2. As seen in FIG. 2, the boil-rate is made up of two components: a fixed component due to thermal heating, and a Joule heating component ($I^2R$) due to the current flow. Thus, even when the current flowing in the bus is zero, there is still a significant amount of heat introduced into the liquid helium due to the thermal conduction properties of the bus. At full current, the optimized lead design is such that all of the heat input is due to Joule heating.

Figure 3:
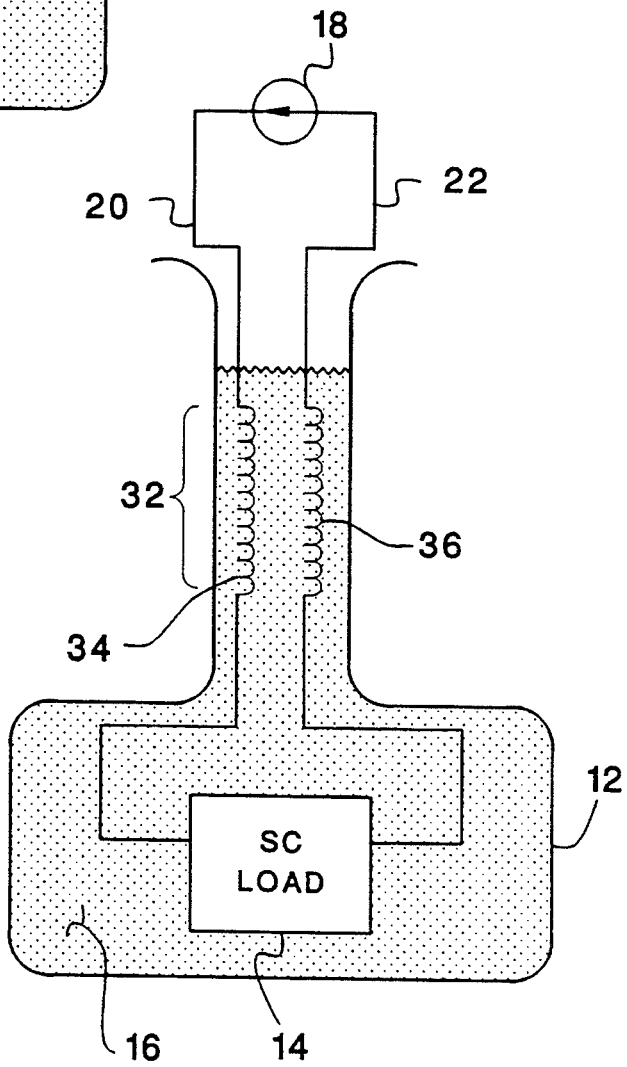
FIG. 3 (PRIOR ART)
FIG. 3 schematically depicts a prior art approach to minimize the liquid helium boil-off rate in the dewar by selectively adjusting the level of the liquid helium in a narrow neck portion of the dewar, thereby selectively immersing portions of a superconductive material in the liquid helium.

FIG. 3 schematically depicts one prior art approach used to minimize the liquid helium boil-off rate. Such approach is described in U.S. Pat. No. 4,369,636, previously referenced. The approach described in the '636 patent selectively adjusts the level of liquid helium in a narrow neck portion 32 of a dewar 30 through which the current-carrying buses 20 and 22 pass as they go to and from the load 14. Those portions 34 and 36 of the buses 20 and 22 that pass through the narrow neck portion 32 are made with a conductive material that has a high thermal resistance (e.g., a material that does not conduct heat as well as a copper, or a longer length of copper than would otherwise be used) and are laced with a ribbon of superconducting material at the lower areas where the current densities might otherwise be too high for the resistive material used or the smaller cross-sectional area. At maximum current flow, the level of the liquid helium is raised so as to immerse the portions 34 and 36, rendering such portions superconducting. As the current flow to the load 14 decreases, the liquid helium level in the neck portion 32 is incrementally lowered. This helps to maintain the lead operating closer to the theoretical minimum heat load for that current. At near-zero current, the helium boil-off rate caused by thermal conduction is reduced as the liquid helium level is lowered to the bottom of the lead because the thermal resistance of the lead above the liquid helium level is increased significantly.

In contrast to the scheme depicted in FIG. 3, which scheme requires a sophisticated control system for incrementally controlling the liquid helium level within the neck portion 32, the present invention utilizes a current shunting configuration 38, referred to as a shuntable low loss variable current vapor cooled lead (VCVCL) configuration, that automatically distributes current among an array of leads so that they operate, as a whole, closer to the theoretical minimum heat load over a full range of current. Such VCVCL configuration 38 is functionally illustrated in the electrical schematic diagram of FIG. 4, and is further illustrated in the sequential state diagrams of FIGS. 5A–5D. It is the purpose of the VCVCL configuration 38 to couple a current source 40 to a superconductive load 42 located within a containment vessel 44 wherein liquid helium (or other suitable cryogenic liquid) is held.

Figure 4:
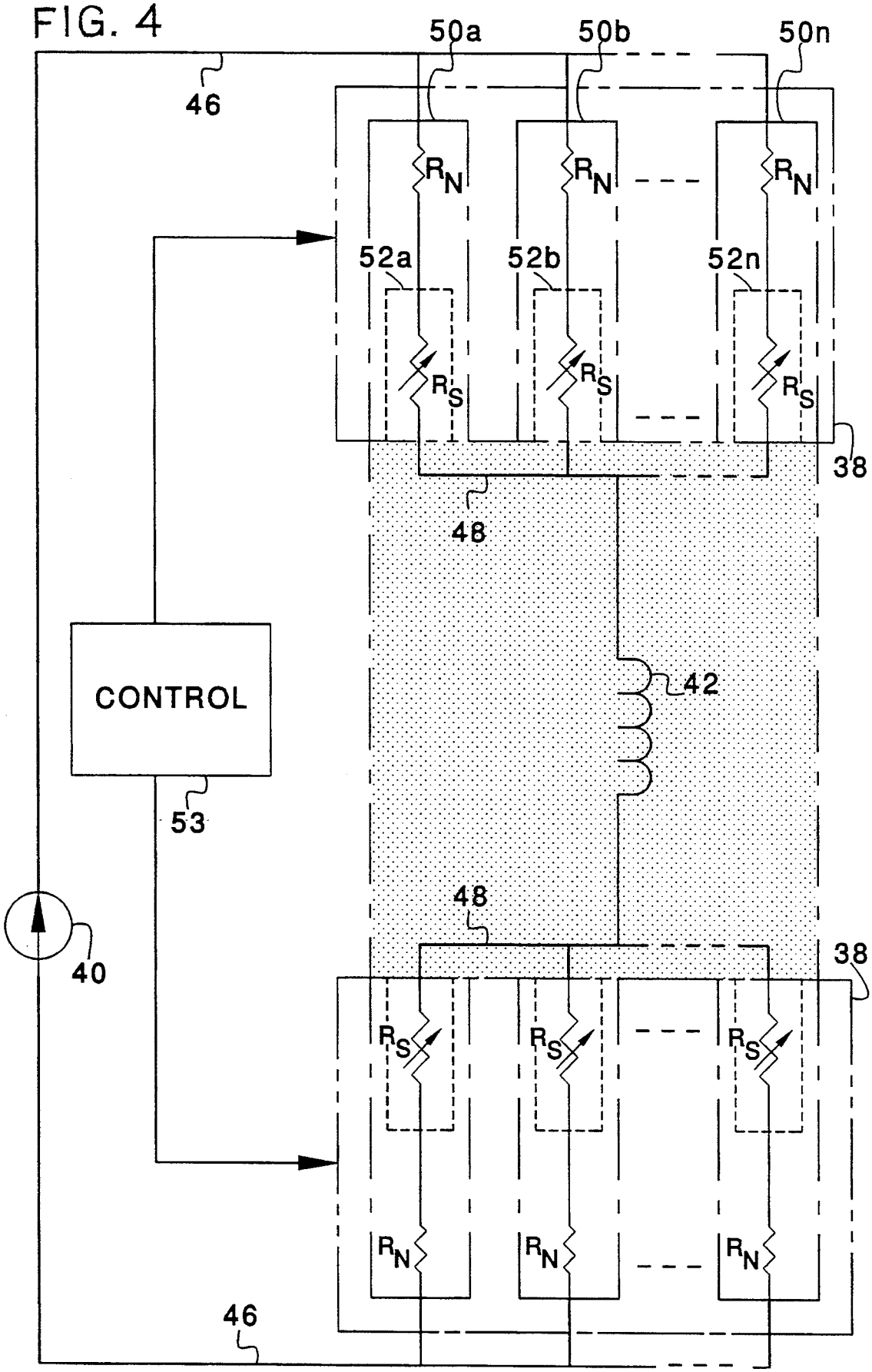
FIG. 4 is an electrical diagram of a shuntable low loss variable current vapor cooled lead (VCVCL) configuration made in accordance with the present invention that directs current to, and returns current from, a superconductive load.

The current carrying bus that connects the current source to the VCVCL configuration is referred to as the "warm bus" 46, and the current carrying bus that connects the VCVCL configuration to the superconductive load 42 is referred to as the "cold bus" 48. The cold bus 48 is immersed in liquid helium 16, and the warm bus 46 is not immersed in liquid helium. Thus, it is the basic function of the VCVCL configuration 38 is to connect the warm bus 46 to the cold bus 48 in a manner that minimizes the liquid helium boil-off rate caused by the VCVCL configuration, regardless of the amount of current flow through the warm and cold buses. Note, as illustrated in FIG. 4, in order to both deliver current to and return current from the superconducting load 42, there are actually two warm buses and two cold buses that are required, one for delivery and one for return. However, for purposes of understanding the present invention, it is sufficient to refer simply to the VCVCL configuration 38 connected between the warm bus 46 and the cold bus 48.

As seen in FIG. 4, the VCVCL configuration 38 includes a plurality of shuntable VCVCL assemblies 50*a*, 50*b*, ... 50*n* connected in parallel between the warm bus 46 and the cold bus 48. Each VCVCL assembly includes a fixed conductive portion, $R_N$, in series with an adjustable conductive portion, $R_S$. The resistance of the fixed conductive portion $R_N$ includes the resistance of the warm bus. The adjustable conductive portion $R_S$ has a variable resistance that is controlled by a control circuit 53.

The preferred technique for adjusting the resistance of $R_S$ is to selectively control the level of liquid helium that covers the current leads. This is done by fabricating a lower portion of $R_S$ so that it includes a segment of superconductive material (e.g., NbTi or $Nb_3Sn$) with just enough copper surrounding it so it is stable enough to carry the full current when it is submersed in liquid helium. Typically, for ease of construction, the superconductive segment is wrapped around the copper substrate in a spiral, although such spiral winding is not necessary. Thus, when immersed in liquid helium, the superconductive segment of $R_S$ exhibits superconductive properties (zero resistance) and carries all of the current flow. When not immersed in liquid helium, the superconducting segment exhibits a higher resistance, so the copper substrate carries most of the current.

Since the copper substrate of the $R_S$ portion is further constructed so it has only enough cross sectional area to stabilize the superconductor at cryogenic temperatures, it exhibits a lower thermal conductivity over the same temperature range than does the fixed conductive portion, $R_N$.

Selective immersion of the superconductive lower segment of $R_S$ in liquid helium is achieved by surrounding the $R_S$ portion of each respective VCVCL assembly with a containment jacket. That is, a containment jacket 52*a* surrounds the $R_S$ portion of the VCVCL assembly 50*a*; a containment jacket 52*b* surrounds the $R_S$ portion of the VCVCL assembly 50*b*, and so on, with a containment jacket surrounding each of the $R_S$ portions of each VCVCL assembly up through the VCVCL assembly 50*n*. The function of the control circuit 53 is thus to selectively and independently control the level of liquid helium to one of two levels in each of the containment jackets 52*a*, 52*b*, ... 52*n*. The two levels are either "high", wherein the liquid helium covers the superconducting portion of $R_S$, or "low", wherein the livid helium level is maintained at the bottom of the $R_S$ segment, thereby exposing the superconductor and causing it to cease superconducting. Such level control can be easily achieved using conventional fluid control devices, such as pumps, valves, storage tanks, and the like, as is known in the art. Advantageously, only two levels of liquid helium are ever needed in each containment jacket: high or low.

The preferred relationship between the resistance values of the fixed conductive portion $R_N$ and the adjustable conductive portion is such that $R_S$(superconducting) $<<R_N<<[R_N+R_S$(non-superconducting)].

In operation, the control circuit 53 selectively adjusts the conductive portion $R_S$ of each VCVCL assembly as a function of the current demand of the superconducting load 42 by varying the liquid helium level. Thus, if the load 42 demands a total maximum current, $I_T$, then all of the $R_S$ portions of each VCVCL assembly 50*a*, 50*b*, ... 50*n* are adjusted to exhibit superconductivity, and an optimum current $I_M$ flows through each assembly. The number of assemblies n that are used in the VCVCL configuration 38 is a function of the maximum (optimum) current of each assembly. If the maximum (optimum) current for each assembly 50*a*, 50*b*, ... 50*n* is the same, e.g. $I_M$, then the number n of assemblies needed is simply determined by dividing $I_T$ by $I_M$. As the current demands of the superconducting load diminish by increments of approximately $I_M$, the control circuit 53 simply adjusts the $R_S$ portion of one of the VCVCL assemblies so that it is no longer exhibits superconductive properties. Such action automatically causes the resistance of that VCVCL assembly to rise to a value that is much greater than the resistance of the other VCVCL assemblies that are in parallel therewith. Hence, very little (if any) current flows in such VCVCL assembly, and the current in the other VCVCL assemblies returns to a value of or near $I_M$. The control circuit continues this process, as the load current demand diminishes, so that each VCVCL assembly has either a current at or near its optimum current, $I_M$, flowing therethrough, or has near-zero current flowing therethrough. At near-zero current, of course, the liquid helium boil-off rate due to $I^2R$ losses (Joule heating) is negligible. Also, when not immersed in liquid helium, i.e., when the level of the liquid helium in the containment jacket of the respective VCVCL assembly is low, the geometry of the $R_S$ portion significantly minimizes thermal conductivity through such assembly. Hence, the helium boil-off rate due to thermal conductivity is greatly reduced.

To further illustrate operation of the VCVCL configuration 38, reference is next made to FIGS. 5A–5D, where there is shown a sequence of the various states of the VCVCL assemblies that are included within the VCVCL configuration 38. FIGS. 5A–5D assume that the VCVCL assembly 38 is made up of three VCVCL assemblies 50*a*, 50*b* and 50*c*. The three VCVCL assemblies are connected in parallel between an input power bus (warm bus) 46 and a superconductive power bus (cold bus) 48. Each VCVCL assembly 50*a*, 50*b*, 50*c* includes an upper portion 54, having a large cross-sectional area, and a lower conductive portion 56, having a smaller cross-sectional area. The upper conductive portion 54 is typically made from a copper tube designed as a counterflow heat exchanger. The length-to-cross-sectional area ratio, L/A, of the upper portion 54 is optimized so as to minimize the helium boil-off rate at a maximum current, $I_{MAX}$, whenever the liquid helium is maintained at its "high" level (so as to be at the bottom of the upper portion 54). The lower conductive portion 56 is made from a copper substrate (which may also be a tube) and a superconductor, and has a much smaller cross-sectional area than the upper portion 54. Hence, the amount of heat that can be transferred to the liquid helium through such smaller cross-sectional area portion 56 (if the liquid helium were at the bottom of portion 56) is significantly reduced over that which would be introduced through the larger cross-sectional area portion 54 (if the liquid helium were at the bottom of portion 54).

The lower portion 56 of the each assembly 50*a*, 50*b*, 50*c* contains a superconductive material 58 bonded to the copper substrate, thereby converting such portion 56 into a superconducting tube when the lower portion 56 is immersed in liquid helium. The superconductive material 58 must be in close contact, i.e., in electrical and physical contact, with the copper substrate. The copper substrate thus serves as a stabilizer that provides physical support for the superconductive material 58.

As further illustrated in FIGS. 5A–5D, each of the lower tube portions of the VCVCL assemblies 50*a*, 50*b* and 50*c* is surrounded by a containment jacket 52*a*, 52*b* and 52*c* designed to hold liquid helium. The level of liquid helium in the jackets 52*a*, 52*b* and 52*c* is individually and independently controllable by the control circuit 53 (FIG. 4).

Figure 5A:
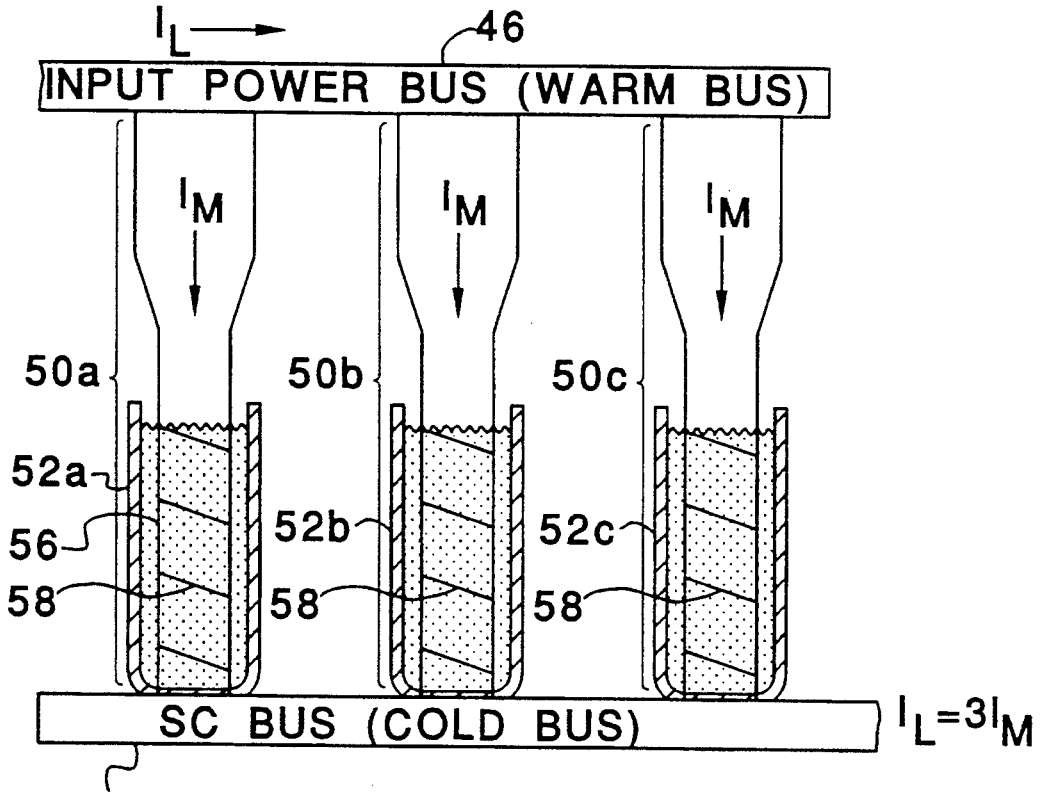
FIGS. 5A–5D schematically depict various states of a shuntable low loss VCVCL configuration made in accordance with the present invention that includes, e.g., three VCVCL assemblies connected in parallel between an input power bus maintained at normal temperatures and a superconductive power bus maintained at cryogenic temperatures, which configuration maintains the amount of current flowing in each VCVCL assembly at near an optimum level, despite the fact that the total current delivered to the superconductive load through the output superconductive power bus may vary over a wide range.
Figure 5B:
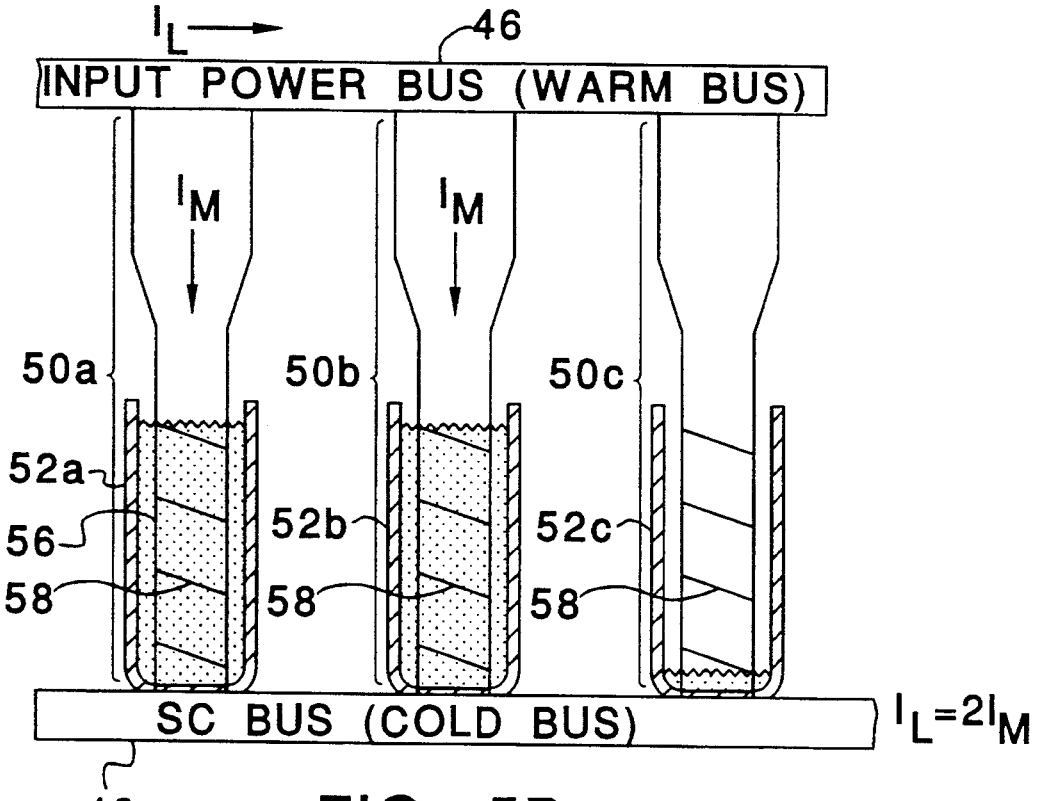
Figure 5C:
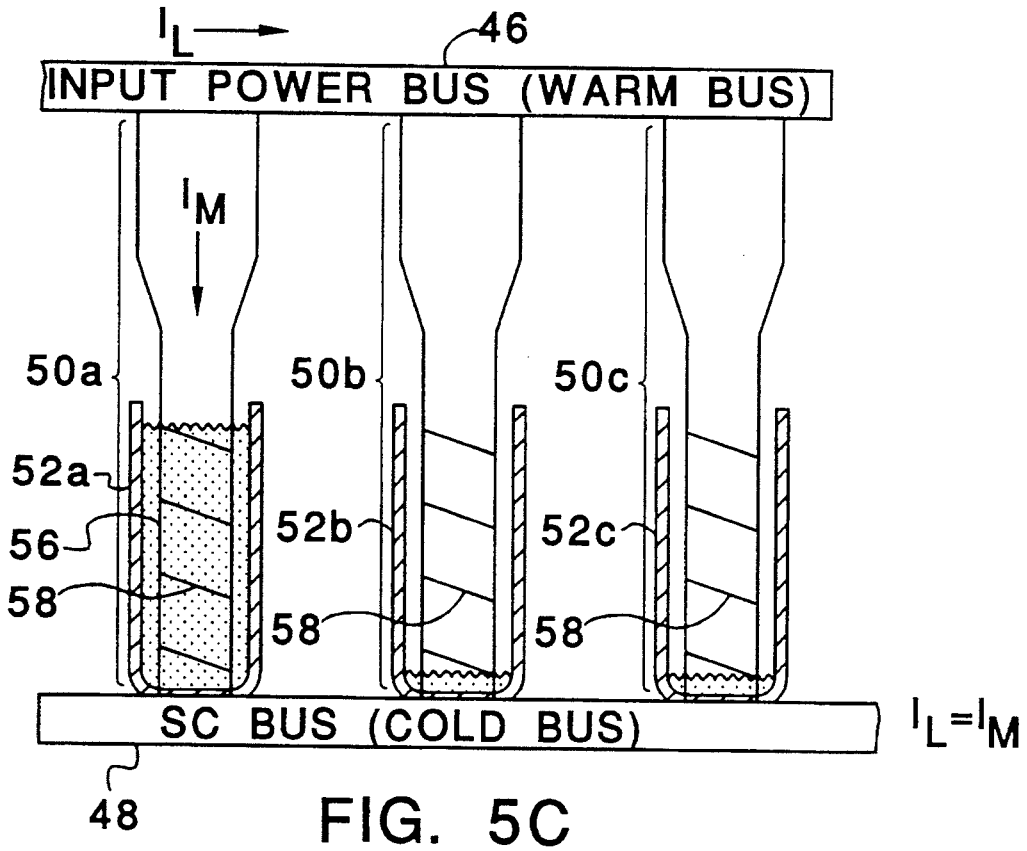
Figure 5D:
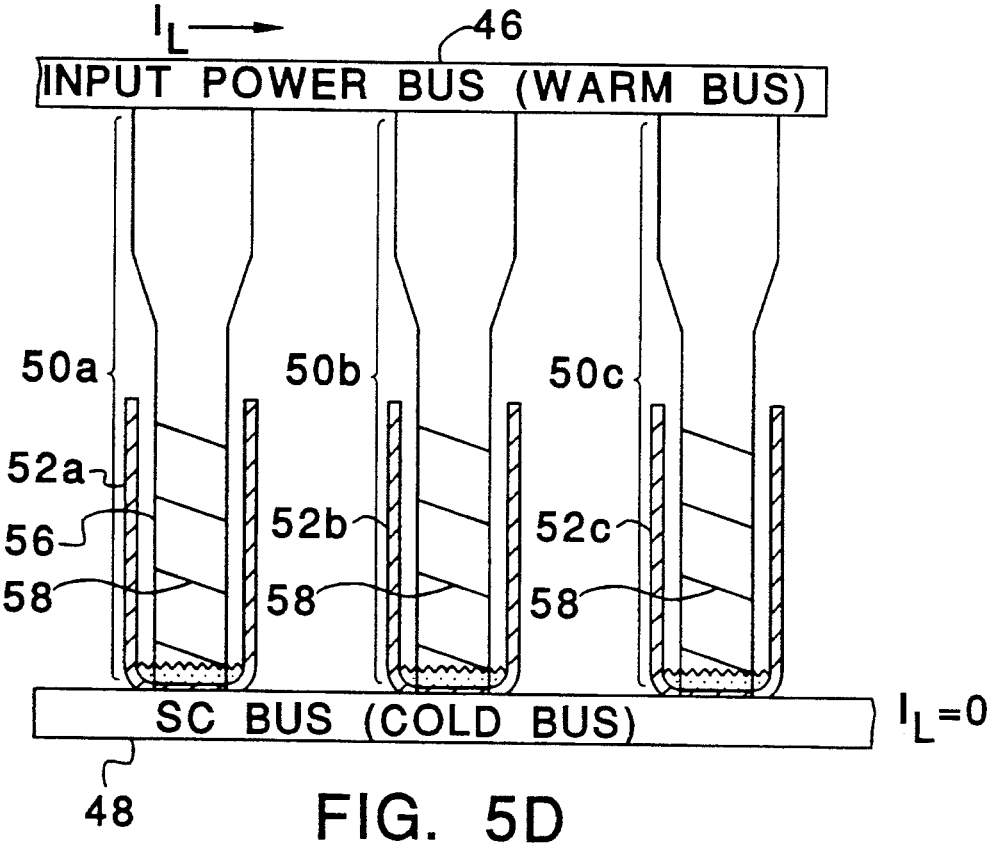

When a maximum total current $I_T$ is to flow through the warm and cold power buses, i.e., when the load current $I_L$ is equal to $I_T$, all three of the jackets 52*a*, 52*b* and 52*c* are filled with liquid helium to the "high" level, as shown in FIG. 5A. Under these conditions a maximum (optimum) current, $\frac{1}{3}I_T$, thus flows in each assembly, where $\frac{1}{3}I_T=I_M$, where $I_M$ is the optimally designed current for each VCVCL assembly. The overall boil-off rate of the liquid helium is thus at a maximum value, as shown at point 60 on the graph of FIG. 6. Although the boil-off rate at point 60 is at a high value, it is an optimum value (the lowest value possible) for the amount of current that is flowing through the power buses.

Figure 6:
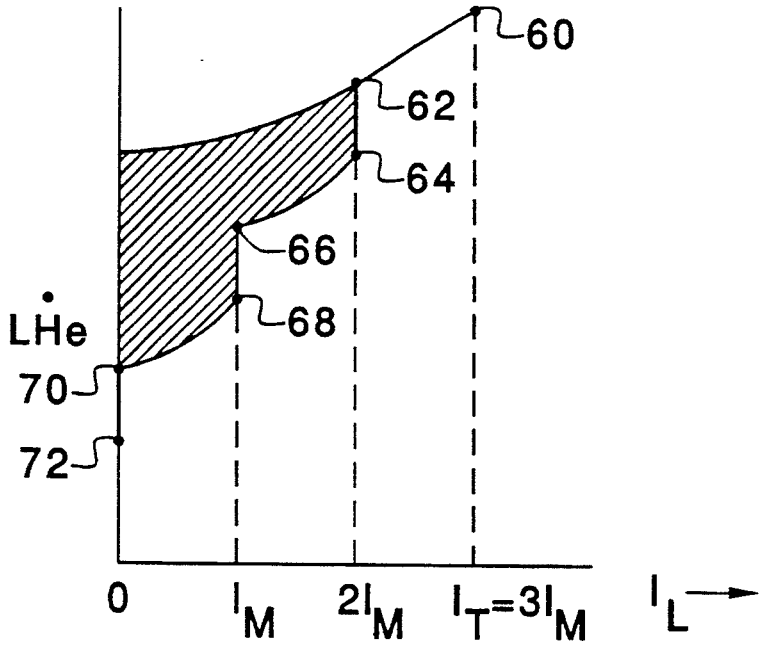
FIG. 6 is a graph that qualitatively illustrates the helium boil-off rate as a function of total load current for the shuntable low loss VCVCL configuration of FIGS. 4–5.

As the load current decreases, the boil-off rate also decreases as depicted by the graph of FIG. 6 between the points 60 and 62. When the total current decreases to about $\frac{2}{3}I_T$, the control circuit lowers the helium level in the containment jacket 52*c* of the VCVCL assembly 50*c* to its "low" level so that the lower portion 56 of such assembly is exposed (not immersed in liquid helium). The containment jackets 52*a* and 52*b*, on the other hand, remain full of liquid helium (the liquid helium level remains at the "high" level), thereby fully immersing the lower portions 56 of the VCVCL assemblies 50*a* and 50*b* in the liquid helium. Under such conditions, shown in FIG. 5B, the total resistance of the assembly 50*c* rises significantly compared to the total resistance of the VCVCL assemblies 50*a* and 50*b*, so most of the current flowing in the VCVCL assembly 50*c* is shunted to the VCVCL assemblies 50*a* and 50*b*, which current ($\frac{2}{3}I_T$) is split between these two current paths (the VCVCL assemblies 50*a* and 50*b*). Because very little current flows in the VCVCL assembly 50*c*, the VCVCL assembly 50*c* contributes very little, if any, Joule heating to the liquid helium, and also contributes very little thermal heating to the liquid helium because the lower portion 56 of the assembly 50*c* (which has a smaller cross-sectional area) provides a poor thermal path. In contrast, each of the VCVCL assemblies 50*a* and 50*b* has the current restored therein to near the maximum (optimum) value $I_M$ (where $I_M=\frac{1}{3}I_T$). Hence, with the current in the VCVCL assembly 50*c* being reduced to near zero, and with the poor thermal conduction path provided by the narrow portion 56 of the VCVCL assembly 50*c*, the helium boil-off rate of all of the assemblies combined reduces to a point 64 on the graph of FIG. 6.

As the load current further decreases, the boil-off rate also decreases as depicted by the graph of FIG. 6 between the points 64 and 66. When the total current decreases to about $\frac{1}{3}I_T$, the control circuit lowers the helium level in the containment jacket 52*b* of the VCVCL assembly 50*b* to its "low" level so that the lower portion 56 of such assembly is exposed (not immersed in liquid helium), as is the case with the assembly 50*c*. The containment jacket 52*a*, on the other hand, remains full of liquid helium, thereby fully immersing the lower portion 56 of the VCVCL assembly 50*a* in the liquid helium. Under such conditions, shown in FIG. 5C, the total resistance of the assembly 50*b* rises significantly compared to the total resistance of the VCVCL assembly 50*a*, so most (if not all) of the current flowing in the VCVCL assembly 50*b* is shunted to the VCVCL assembly 50*a*, which current ($\frac{1}{3}I_T$)) returns the current flowing through the VCVCL assembly 50*a* back to near its optimum level. Because very little current flows in the VCVCL assemblies 50*b* and 50*c*, such assemblies 50*b* and 50*c* contribute very little Joule heating to the liquid helium, and such assemblies also contribute very little thermal heating to the liquid helium because the smaller cross sectional area of each assembly provides a poor thermal path. Hence, with the current in the VCVCL assemblies 50*b* and 50*c* being reduced to near zero, and with the poor thermal conduction path provided by the lower portions 56 of the VCVCL assemblies 50*b* and 50*c*, the helium boil-off rate of all assemblies combined reduces to a point 68 on the graph of FIG. 6.

As the load current continues to decrease, the boil-off rate also decreases as depicted by the graph of FIG. 6 between the points 68 and 70. When the total current decreases to zero, the control circuit lowers the helium level in the containment jacket 52*a* of the VCVCL assembly 50*a* to its "low" level so that the lower portion 56 of such assembly is exposed (not immersed in liquid helium), as is the case with the assemblies 50*b* and 50*c*. Under such conditions, shown in FIG. 5D, there is no further Joule heating (because the total current is zero), and all three VCVCL assemblies 50*a*, 50*b* and 50*c* provide a poor thermal path into the liquid helium because of the small cross sectional area associated with the lower portion 56 of each assembly. Hence, the helium boil-off rate of all the assemblies reduces to a point 72 on the graph of FIG. 6.

Thus, as described above, it is seen that the VCVCL configuration 38 shown in FIGS. 5A–5D either reduces the current flowing in a given VCVCL assembly to near zero, or maintains the amount of current at or near an optimum level, despite the fact that the load current $I_L$ delivered to the superconducting load through the output power bus may vary over a wide range. As a result, significant savings are realized in the helium boil-off rate over what would be achieved without using the low loss VCVCL configuration 38. Such savings are graphically depicted in FIG. 6 as the cross-hatched portion 74. Given the high cost of creating and maintaining liquid helium, such savings are significant.

Figure 7:
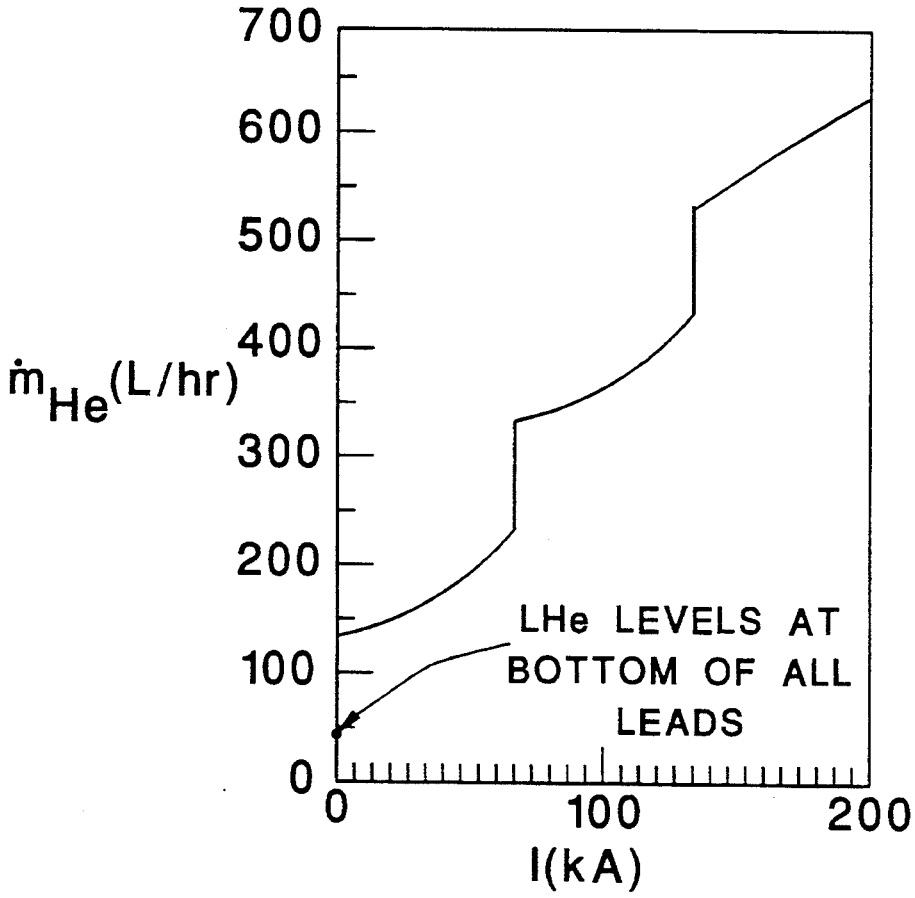
FIG. 7 is a graph that quantitatively shows the helium boil-off rate as a function of total load current for a shuntable low loss VCVCL configuration as in FIGS. 4–5 that delivers a maximum of 200 kA to an SMES load.

By way of example, the quantitative performance of a VCVCL configuration using three VCVCL assemblies to deliver a maximum current of 200 kA to an SMES load is shown in FIG. 7. FIG. 7 also clearly shows that the savings in helium boil-off rate are significant.

Figure 8:
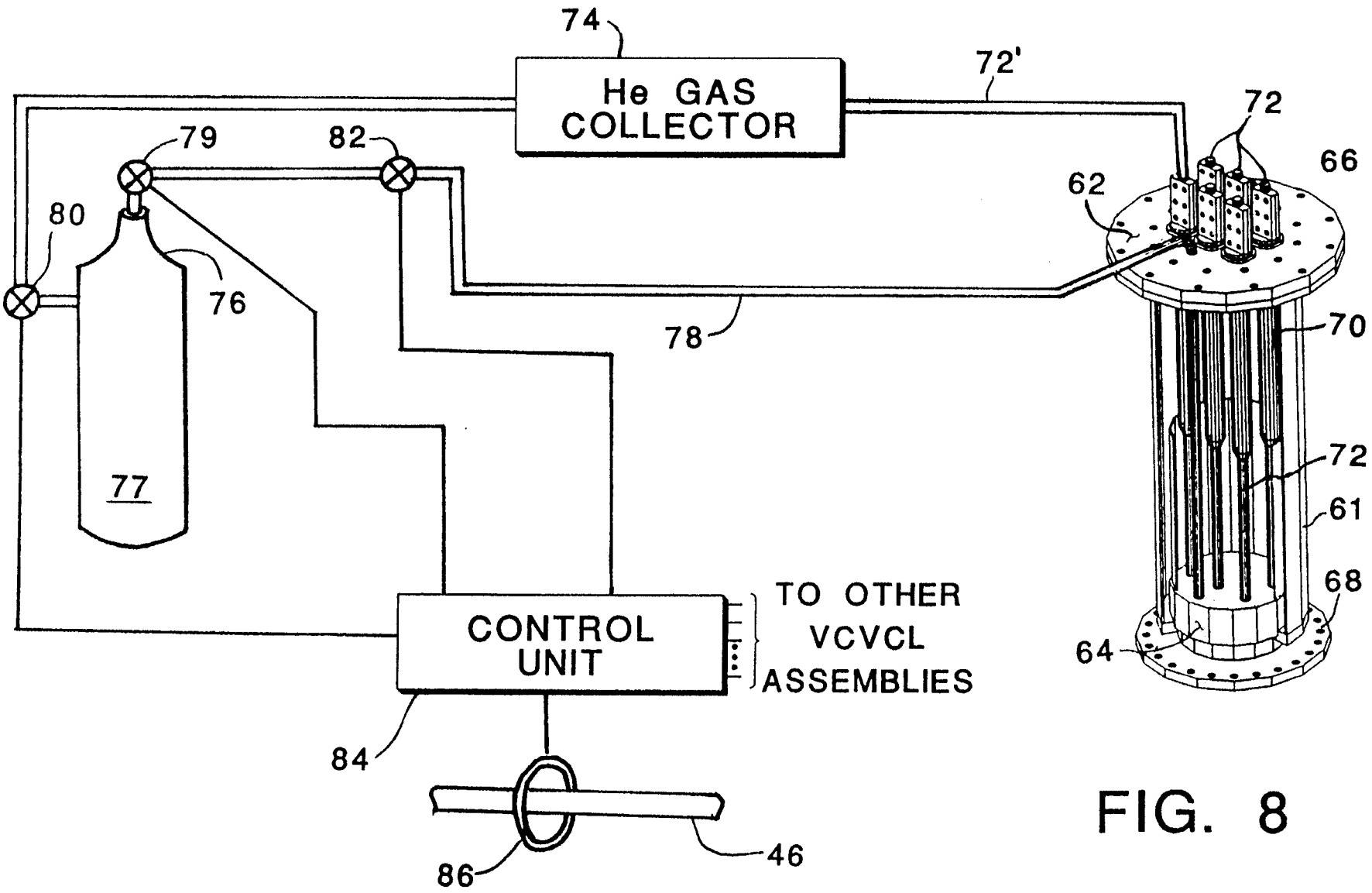
FIG. 8 diagrammatically depicts a shuntable low loss VCVCL assembly of the type that may be used within a VCVCL configuration, and shows in block diagram form some of the control and supply elements that are used by a VCVCL configuration.

Turning next to FIG. 8, there is shown a diagrammatic representation of a shuntable low loss VCVCL assembly 50 made in accordance with the present invention. Such assembly 50 may be used, e.g., as any one of the VCVCL assemblies 50*a*, 50*b*, ... 50*n* shown in FIGS. 4 or 5A–5D. The assembly 50 is adapted to be connected between an input power bus (warm bus) 46 and a superconductive power bus (cold bus) 48. As seen in FIG. 7, which shows the assembly 50 with portions thereof cutaway, the assembly 50 generally comprises a hollow tubular assembly 60, with the tube being formed from a circular wall 61, and with a first end cap 62 being sealed to the wall 61 at one end of the assembly, and with a second end cap 64 being sealed to the wall 61 at the other end of the assembly. The wall of the tubular assembly 60 and the end caps 62 and 64 thus form a dewar or containment jacket wherein liquid helium may be raised or lowered. Connection to the warm bus 46 is made by way of one or more connection stubs 66 that protrude through the first end cap 62. Connection to the cold bus 46 is made by way of a flange connection 68 that extends out from the second end cap 64.

Each stub 66 is connected to the flange 68 by way of a copper lead tube 70. For the configuration shown in FIG. 7, six copper lead tubes are used, all of which are maintained within the dewar so as to be substantially parallel to each other, and uniformly spaced within the interior of the dewar. However, it is to be emphasized that the use of six lead tubes is only exemplary, as any number of tubes may be used, depending on how much current must flow through the tubes at maximum current conditions.

About mid-way along the length of the copper lead tubes 70, the cross-sectional area of the copper decreases by at least a factor of five. That portion of the tubes 70 having a smaller or narrower size may be fabricated from copper with superconductive wire soldered to it. Or, as an alternative, the entire segment can be fabricated from superconductive cable containing copper wound around a non-conducting tube for support. Thus, such smaller-area portion may be considered as a superconductive lead tube 72. The manner of bonding or pressing a superconductive material into close contact with the copper substrate to form a complete conductor is known in the art, see, e.g., the '636 patent, incorporated herein by reference. The larger copper lead tubes 70 connected to the warm bus stubs 66 of the VCVCL assembly, and the smaller superconducting lead tubes 72 at the end of the dewar connected to the cold bus flange 68, thus function as the $R_S$ portion of the VCVCL assembly, as described above in connection with FIG. 4. External jumper cables that connect each assembly between the stubs 66 and the warm bus functions as the $R_N$ portion of the assembly as described above in connection with FIG. 4.

Still referring to FIG. 7, helium vent tubes 72 pass through the center of each of the copper lead tubes 70, and provide a means for capturing any helium gas that boils off from the liquid helium contained in the dewar. Such captured helium gas is collected in a helium gas collector 74, where it may be condensed using a liquefier 76, as is known in the art. The liquid helium created by the liquefier 76 is collected in a liquid helium supply tank 77, which supply tank 77 may double as the main dewar in which the superconducting load is immersed. The liquid helium is pumped into the dewar by means of a supply tube 78 and by means of a pump 79, or gravity flow, and through use of appropriate valves 80 and 82 and supply lines, in conventional manner. Similarly, as required, the liquid helium may be pumped out of, or drained out of, the dewar and stored in the tank 77.

A control unit 84 operates the values 82 and 80 and pump 79 so as to control whether the tubular dewar 60 is full or empty of liquid helium as a function of the load current $I_L$. The load current $I_L$ may be monitored by using a current probe 86 placed around the input power bus (warm bus) 46. Other means for monitoring the load current may also be employed, such as monitoring the voltage across a known length of the power bus having a known resistance. The control unit 84 is of conventional design, and includes a programmable computer, such as a 386- or 486-based CPU having a main program that defines the break points at which one dewar (VCVCL assembly) should be filled or emptied with liquid helium, and appropriate solenoids and other control devices and sensors to control operation of the various valves, pumps, liquefiers, and the like that are used as the respective tubular dewars 60 of the VCVCL assemblies are filled and emptied. Only two sensors are needed in each tubular dewar, one to indicate when the dewar is full, and one to indicate when it is empty. In some instances, the same sensor can be used for both levels if it is long enough.

Advantageously, using the VCVCL configuration described above, the present invention also provides a method of delivering electrical currents to a superconductive load held in a dewar filled with a cryogenic liquid, e.g., liquid helium. Such method includes the following steps. First, a plurality of shuntable low loss variable current vapor cooled lead (VCVCL) assemblies is formed. Each of the VCVCL assemblies includes: a superconductive material electrically connected between an input power bus connection and an output power bus connection, and means for independently immersing the superconductive material of a selected VCVCL assembly within the cryogenic liquid. The superconductive material of each VCVCL assembly exhibits a zero electrical resistance when the superconductive material is immersed within the cryogenic liquid, and exhibits a finite electrical resistance when not immersed within the cryogenic liquid. Each assembly is designed for minimizing the helium boil-off rate at a maximum current $I_M$.

Second, a plurality of the VCVCL assemblies formed in the first step are connected in parallel between a superconductive power bus (cold bus) within the dewar and an input power bus (warm bus) not within the dewar. This is done by connecting the output power bus connection of each VCVCL assembly to the superconductive power bus, and by connecting the input power bus connection of each VCVCL assembly to the input power bus. It is understood, of course, that the superconductive power bus is connected to the superconductive load, and the input power bus is connected to a source of input power.

Third, the load current, $I_L$, required by the superconductive load is determined and such total current is supplied to the input power bus.

Then, fourth, the superconductive material of n of the VCVCL assemblies is immersed within a cryogenic liquid, where n is an integer that represents the number of VCVCL assemblies needed to provide the desired load current, $I_L$, and by not immersing the superconductive material of any remaining VCVCL assemblies. This action forces the load current, $I_L$, to be delivered to the load through those VCVCL assemblies that have their superconductive material immersed in the cryogenic liquid, while no significant current flows through the VCVCL assemblies not having their superconductive material immersed in the cryogenic liquid. This occurs because, as explained previously, the finite resistance of such non-immersed VCVCL assemblies automatically shunts the current to the parallel VCVCL assemblies having a lower resistance. In this manner, then, each of the VCVCL assemblies that delivers current to the superconductive bus operates at near its specified operating current, thereby minimizing the boil-off rate of the cryogenic liquid that is exposed to such VCVCL assemblies.

While the invention herein disclosed has been described by means of specific embodiments and applications thereof, numerous modifications and variations could be made thereto by those skilled in the art without departing from the scope of the invention set forth in the claims.

What is claimed is:

1. In combination, a superconductive magnet and cooling apparatus therefor, said cooling apparatus comprising:

a containment vessel for cryogenic liquid, said superconductive magnet being disposed within said containment vessel;

a superconductive power bus electrically connected to said superconductive magnet, said superconductive power bus being disposed within said containment vessel;

a plurality of shuntable low loss variable current vapor cooled lead (VCVCL) assemblies connected in parallel between said superconductive power bus and an input power bus, said input power bus being disposed outside of said containment vessel, each of said VCVCL assemblies including:

a superconductive material that is electrically connected between said input power bus and said output power bus, a containment jacket surrounding said superconductive material, and filling means for independently and selectively filling said containment jacket with a cryogenic liquid, so as to completely immerse said superconductive material, said superconductive material exhibiting superconducting properties when immersed within said cryogenic liquid, and not exhibiting superconducting properties when not immersed within said cryogenic liquid;

whereby the conduction properties of each of said VCVCL assemblies may be selectively controlled between either a superconducting state exhibiting virtually no resistance, or a non-superconducting state exhibiting a finite resistance, as a function of whether said superconductive material of each VCVCL assembly is completely immersed within said cryogenic liquid by said filling means or completely exposed out of said cryogenic liquid by said filling means;

whereby the current flow within each of said VCVCL assemblies may be controlled by said filling means, with the current flow through a given VCVCL assembly that exhibits a finite resistance being shunted to a parallel VCVCL assembly that exhibits a much lower resistance.

2. The apparatus as set forth in claim 1 wherein each of said VCVCL assemblies, in order to minimize the rate at which the cryogenic liquid boils off within said containment jacket, is designed to operate at an optimum current level, and wherein said superconductive magnet requires different magnitudes of current flowing thereto at different times of its operation, and further including control means for controlling the total current flowing in said input power bus so that it equals the magnitude of current needed by said superconductive magnet at any given time, said control means further including means for controlling said filling means so as to adjust the cryogenic liquid contained in each of said containment jackets in order to adjust the resistance of a given VCVCL assembly between either a finite resistance or virtually no resistance so that the total amount of current flowing through the plurality of VCVCL assemblies remains near said optimum current level.

3. The apparatus as set forth in claim 2 wherein said superconductive magnet requires a maximum current $I_T$ flowing thereto, and wherein said plurality of VCVCL assemblies comprises n VCVCL assemblies, where n is an integer of at least two, and wherein the optimum current level of each of said VCVCL assemblies is designed to be approximately $I_T/n$, and further wherein said control means controls each of said filling means so that the superconductive material of all of said n VCVCL assemblies is immersed within said cryogenic liquid for all current requirements of said superconducting magnet between $(n-1)I_T/n$ and $I_T$; and wherein said control means controls each of said filling means so that the superconductive material of all but one of said n VCVCL assemblies is immersed within said cryogenic liquid for all current requirements of said superconducting magnet between $(n-2)O_T/n$ and $(n-1)I_T/n$, with said one VCVCL assembly being exposed out of said cryogenic liquid; and where, in general, said control means controls each of said filling means so that the superconductive material of all but f of the VCVCL assemblies, where $0 \leqq i < n$, is immersed within said cryogenic liquid for all current requirements of said superconducting magnet between $[(n-i)-1]I_T/n$ and $(n-i)I_T/n$, with said i VCVCL assemblies having their respective superconductive material exposed out of said cryogenic liquid; thereby maintaining a current flow near $I_T/n$ for each VCVCL assembly having its superconductive material immersed within a cryogenic liquid, and forcing the current flow to near zero for each VCVCL assembly having its superconductive material exposed out of said cryogenic liquid.

4. The apparatus as set forth in claim 3 wherein said cryogenic liquid comprises liquid helium having a temperature of less than about 4.2 degrees Kelvin.

5. The apparatus as set forth in claim 4 further including a collector means for collecting helium gas that boils off of the liquid helium within said containment jackets, and condensing means for condensing said helium gas back to liquid helium for use within said containment jackets by said filling means.

6. The apparatus as set forth in claim 3 wherein each of said VCVCL assemblies comprises a hollow tubular assembly having an input power bus connection at a first end, and a superconductive power bus connection at a second end, and a plurality of superconductive lead tubes inside of said tubular assembly connected in parallel between said input power bus connection and said superconductive power bus connection.

7. The apparatus as set forth in claim 6 wherein each of said superconductive lead tubes is connected to said input power bus connection through a respective copper lead tube.

8. The apparatus as set forth in claim 7 wherein each of said copper lead tubes has a larger cross-sectional area than the superconductive lead tube to which it is connected.

9. The apparatus as set forth in claim 7 wherein each of said superconductive lead tubes comprises a substrate made from copper having a superconductive material bonded into close contact therewith.

10. The apparatus as set forth in claim 9 wherein the cross-sectional area of said copper lead tube is at least a factor of five greater than the cross-sectional area of said superconductive lead tube.

11. The apparatus as set forth in claim 6 wherein at least three superconductive lead tubes are included within said tubular assembly.

12. A shuntable low loss variable current vapor cooled lead (VCVCL) system for connecting an input power bus to a superconductive power bus, said system comprising:

a plurality of shuntable low loss variable current vapor cooled lead (VCVCL) assemblies connected in parallel between said superconductive power bus and said input power bus, each of said VCVCL assemblies including:

a superconductive material that is electrically connected between said input power bus and said output power bus, a containment jacket surrounding said superconductive material, and filling means for independently and selectively filling said containment jacket with a cryogenic liquid, so as to completely immerse said superconductive material, said superconductive material exhibiting superconducting properties when immersed within said cryogenic liquid, and not exhibiting superconducting properties when not immersed within said cryogenic liquid; and control means for selectively controlling each of said filling means as a function of how much current is flowing between said input power bus and said superconductive power bus;

whereby the conduction properties of each of said VCVCL assemblies may be selectively controlled between either a superconducting state exhibiting virtually no resistance, or a non-superconducting state exhibiting a finite resistance, as a function of how much of said superconductive material of each VCVCL assembly is completely immersed within said cryogenic liquid by said filling means; or completely exposed out of said cryogenic liquid by said filling means;

whereby the current flow within each of said VCVCL assemblies may be controlled by said filling means, with the current flow through a given VCVCL assembly that exhibits a finite resistance being effectively shunted to a parallel VCVCL assembly that exhibits a much lower resistance.

13. The shuntable low loss VCVCL system as set forth in claim 12 wherein a maximum current $I_T$ flows between said input power bus and said superconductive power bus, and wherein said plurality of VCVCL assemblies comprises n VCVCL assemblies, where n is an integer of at least two, and wherein each of said VCVCL assemblies is designed to handle an optimum current that is approximately $I_T/n$, and further wherein said control means controls each of said filling means so as to immerse the superconductive material of all of said n VCVCL assemblies within said cryogenic liquid for all currents flowing from said input power bus to said superconducting power bus between $(n-1)I_T/n$ and $I_T$; and wherein said control means controls each of said filling means so as to immerse the superconductive material of all but one of said n VCVCL assemblies within said cryogenic liquid for all currents flowing from said input power bus to said superconducting power bus between $(n-2)I_T/n$ and $(n-1)I_T/n$; and where, in general, said control means controls each of said filling means so as to immerse the superconductive material of all but i of the VCVCL assemblies, where $0 \leqq i < n$, within said cryogenic liquid for all currents flowing from said input power bus to said superconducting power bus between $[(n-i)-1]I_T/n$ and $(n-i)I_T/n$; thereby maintaining a current flow of near $I_T/n$ for each VCVCL assembly having its superconductive material immersed within the cryogenic liquid.

14. The shuntable low loss VCVCL system as set forth in claim 13 wherein each of said VCVCL assemblies comprises a hollow tubular assembly having an input power bus connection at a first end, and a superconducting power bus connection at a second end, and a plurality of superconducting lead tubes inside of said tubular assembly connected in parallel between said input power bus connection and said superconducting power bus connection.

15. The shuntable low loss VCVCL system as set forth in claim 14 wherein each of said superconducting lead tubes is connected to said input power bus connection through a respective copper lead tube.

16. The apparatus as set forth in claim 15 wherein each of said superconducting lead tubes comprises a cylindrical substrate made from a low resistance metal having a superconducting segment bonded thereto.

17. A method of delivering electrical currents to a superconductive load held in a dewar filled with a cryogenic liquid comprising the steps of:

(a) forming a plurality of shuntable low loss variable current vapor cooled lead (VCVCL) assemblies, each of said VCVCL assemblies including: a superconductive material electrically connected between an input power bus connection and an output power bus connection, and means for independently immersing the superconductive material of a selected VCVCL assembly within a cryogenic liquid, the superconductive material in each VCVCL assembly being designed to have a specified operating current, $I_M$, flow therethrough, the resistance of each of said VCVCL assemblies being a first value when said superconductive material is immersed within the cryogenic liquid, and being a second value, much greater than said first value, when not immersed within the cryogenic liquid;

(b) connecting a plurality of the VCVCL assemblies formed in step (a) in parallel between a superconductive power bus within said dewar and an input power bus not within said dewar by connecting the output power bus connection of each VCVCL assembly to said superconductive power bus, and by connecting the input power bus connection of each VCVCL assembly to said input power bus, said superconductive power bus being connected to said superconductive load, and said input power bus being connected to a source of input power;

(c) determining the load current, $I_L$, required by the superconductive load and applying such load current to the input power bus; and then (d) immersing the superconductive material of n said VCVCL assemblies within a cryogenic liquid, where n is an integer that represents the number of VCVCL assemblies needed to provide the load current, $I_L$, to the superconductive load, and by not immersing the superconductive material of any remaining VCVCL assemblies, whereby the load current, $I_L$, is delivered to the superconductive load through those VCVCL assemblies that have their superconductive material immersed in the cryogenic liquid, while no significant current flows through the VCVCL assemblies not having their superconductive material immersed in the cryogenic liquid because the finite resistance of such non-immersed VCVCL assemblies automatically shunts the current to the parallel VCVCL assemblies having lower resistance; whereby each of said VCVCL assemblies that delivers current to said superconducting bus operates at near its specified operating current.

18. The method as set forth in claim 17 wherein step (c) includes sensing the load current $I_L$ delivered to the power input bus, and automatically computing the number of VCVCL assemblies that should be immersed in the cryogenic liquid in order to split the load current between a minimum number of VCVCL assemblies so that each operates near its specified operating current.

19. The method as set forth in claim 18 further including automatically changing the number of VCVCL assemblies immersed in step (d) as a function of the load current $I_L$ sensed in step (c).

* * * * *

UNITED STATES PATENT AND TRADEMARK OFFICE

CERTIFICATE OF CORRECTION

PATENT NO. : 5,353,000

DATED : October 4, 1994

INVENTOR(S) : Morris, et al.

It is certified that error appears in the above-indentified patent and that said Letters Patent is hereby corrected as shown below:

IN THE CLAIMS: In Claim 1, at column 13, line 46, change "superconducting" to --superconductive--. In Claim 1, at column 13, line 48, change "superconducting" to --superconductive--. In Claim 1, at column 13, line 58, after "means" insert a comma --,--. In Claim 2, at column 14, line 4, change "different" to --differing--. In Claim 3, at column 14, line 34, change "$O_T/N$" to --$I_T/N$--. In Claim 12, at column 15 line 50, change "how much of" to --whether--. In Claim 12, at column 15, line 52, after "means", change ";" to --,--.

Signed and Sealed this

Twenty-first Day of February, 1995

*Attest:*

Bruce Lehman

BRUCE LEHMAN

*Attesting Officer*

*Commissioner of Patents and Trademarks*